US009991631B2

(12) United States Patent
Zhao et al.

(10) Patent No.: US 9,991,631 B2
(45) Date of Patent: Jun. 5, 2018

(54) ELECTRICAL CONNECTOR HAVING HOUSING SIDE WALL WITH RESILIENT INNER ARM AND STATIONARY OUTER ARM

(71) Applicant: FOXCONN INTERCONNECT TECHNOLOGY LIMITED, Grand Cayman (KY)

(72) Inventors: Yue-Chao Zhao, Kunshan (CN); Zhi-Jian Chen, Kunshan (CN); Lai-Ang Hu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/668,723

(22) Filed: Aug. 4, 2017

(65) Prior Publication Data

US 2018/0040977 A1 Feb. 8, 2018

(30) Foreign Application Priority Data

Aug. 4, 2016 (CN) ..... 2016 2 0835084 U

(51) Int. Cl.
*H01R 13/627* (2006.01)
*H01R 13/428* (2006.01)

(52) U.S. Cl.
CPC ..... *H01R 13/6273* (2013.01); *H01R 13/428* (2013.01)

(58) Field of Classification Search
CPC ..... H01R 13/6273; H01R 13/4223; H01R 13/4364; H01R 13/4368; H01R 13/428
USPC ..... 439/357
See application file for complete search history.

(56) References Cited

U.S. PATENT DOCUMENTS

| | | | | |
|---|---|---|---|---|
| 5,183,418 | A * | 2/1993 | Yamanashi | H01R 13/4368 439/595 |
| 7,112,102 | B2 | 9/2006 | Masaki et al. | |
| 7,125,258 | B2 | 10/2006 | Nakakubo et al. | |
| 7,708,598 | B2 | 5/2010 | Hu | |
| 9,048,569 | B2 | 6/2015 | Chen | |
| 9,184,531 | B2 | 11/2015 | Chen | |
| 9,240,653 | B2 | 1/2016 | Urano et al. | |
| 9,306,326 | B2 | 4/2016 | Nishiyama et al. | |
| 9,728,884 | B1 * | 8/2017 | Sinha | H01R 13/4364 |
| 2003/0060075 | A1 * | 3/2003 | Nakamura | H01R 13/4223 439/345 |

FOREIGN PATENT DOCUMENTS

| | | |
|---|---|---|
| TW | M400135 U | 3/2011 |
| TW | M436264 U | 8/2012 |

* cited by examiner

*Primary Examiner* — Jean F Duverne
(74) *Attorney, Agent, or Firm* — Wei Te Chung; Ming Chieh Chang

(57) ABSTRACT

An electrical connector (100) includes: an insulative housing having a base (11) and a pair of side walls (12), each side wall having a resilient inner arm (121) and a stationary outer arm (122); and plural contacts (2) retained to the insulative housing, wherein the resilient inner arm extends along a horizontal, front-to-back direction and has a front end operable in both a vertical, top-to-bottom direction and the horizontal, front-to-back direction to move toward the stationary outer arm.

11 Claims, 7 Drawing Sheets

ELECTRICAL CONNECTOR HAVING HOUSING SIDE WALL WITH RESILIENT INNER ARM AND STATIONARY OUTER ARM

BACKGROUND OF THE INVENTION

1. Field of the Invention

The present invention relates to an electrical connector including a U-shaped insulative housing having a pair of resilient inner arms and a pair of stationary outer arms to facilitate mating of a complementary connector in both a horizontal, front-to-back direction and a vertical, top-to-bottom direction.

2. Description of Related Arts

U.S. Pat. No. 9,048,569 discloses a board-end connector including a pair of restricting components and a wire-end connector including a pair of blocking bumps. The restricting component is separately mounted to an insulated housing of the board-end connector and is biased by a corresponding elastic element. Designs of the blocking bumps and the restricting components allow the wire-end connector to be mated with the board-end connector only in a vertical, top-to-bottom direction. To pull the wire-end connector out, different from conventional vertical-type connectors, the blocking bumps and the restricting components are so designed that the wire-end connector is pulled along a horizontal, front-to-back direction.

An electrical connector having an improved restricting and/or blocking structure is desired.

SUMMARY OF THE INVENTION

An electrical connector includes: an insulative housing having a base and a pair of side walls, each side wall having a resilient inner arm and a stationary outer arm; and a plurality of contacts retained to the insulative housing, wherein the resilient inner arm extends along a horizontal, front-to-back direction and has a front end operable in both a vertical, top-to-bottom direction and the horizontal, front-to-back direction to move toward the stationary outer arm.

DETAILED DESCRIPTION OF THE PREFERRED EMBODIMENT

Figure 1:
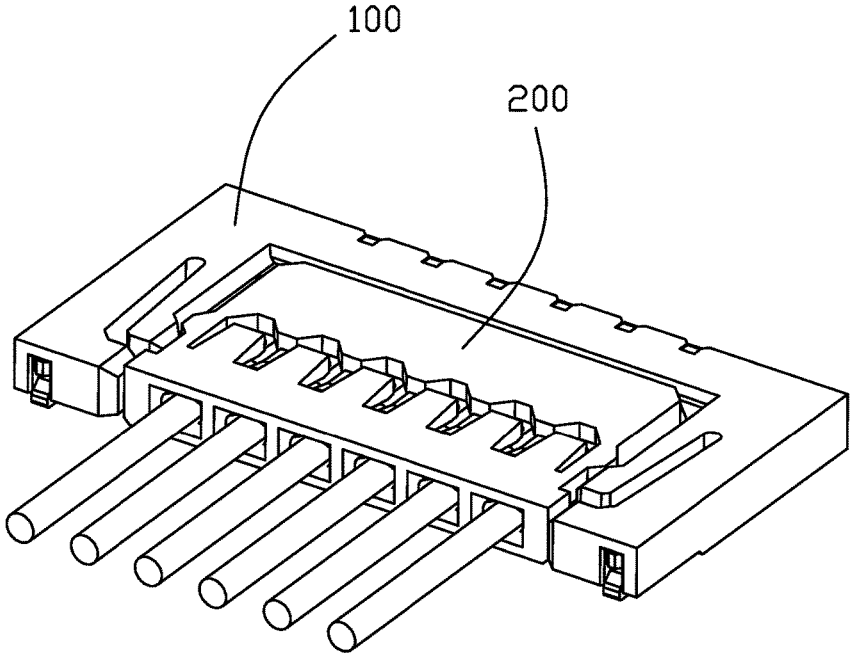
FIG. 1 is an assembled perspective view of an electrical connector assembly in accordance with the present invention.
Figure 2:
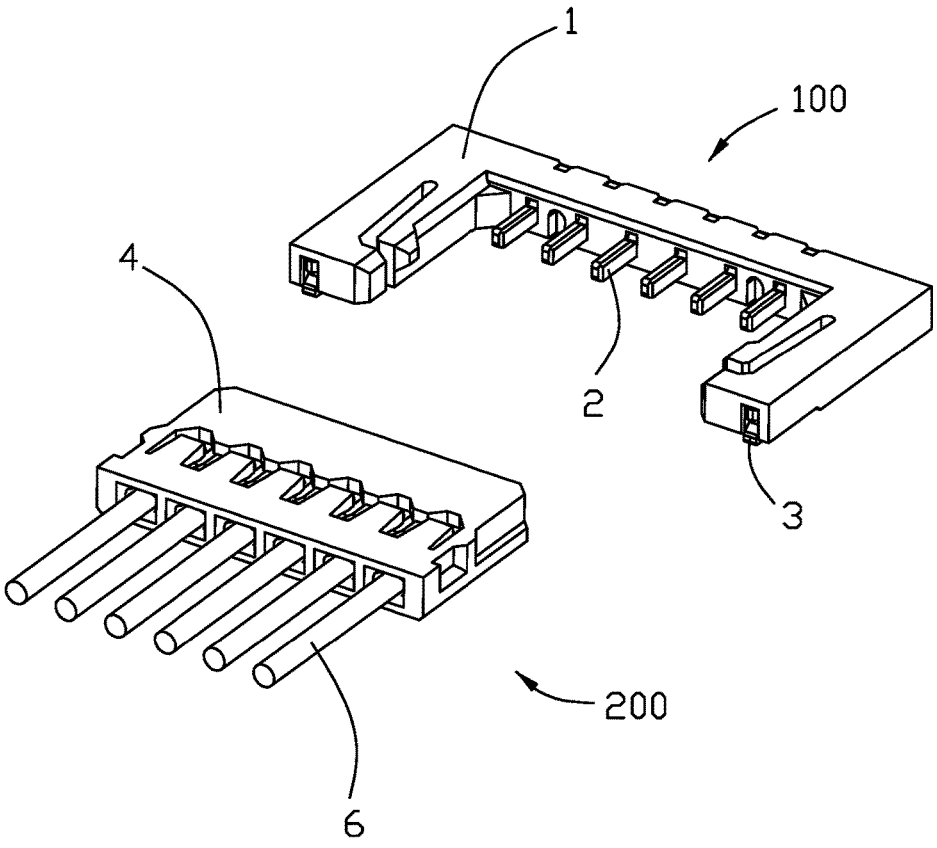
FIG. 2 is an exploded view of the electrical connector assembly.
Figure 3:
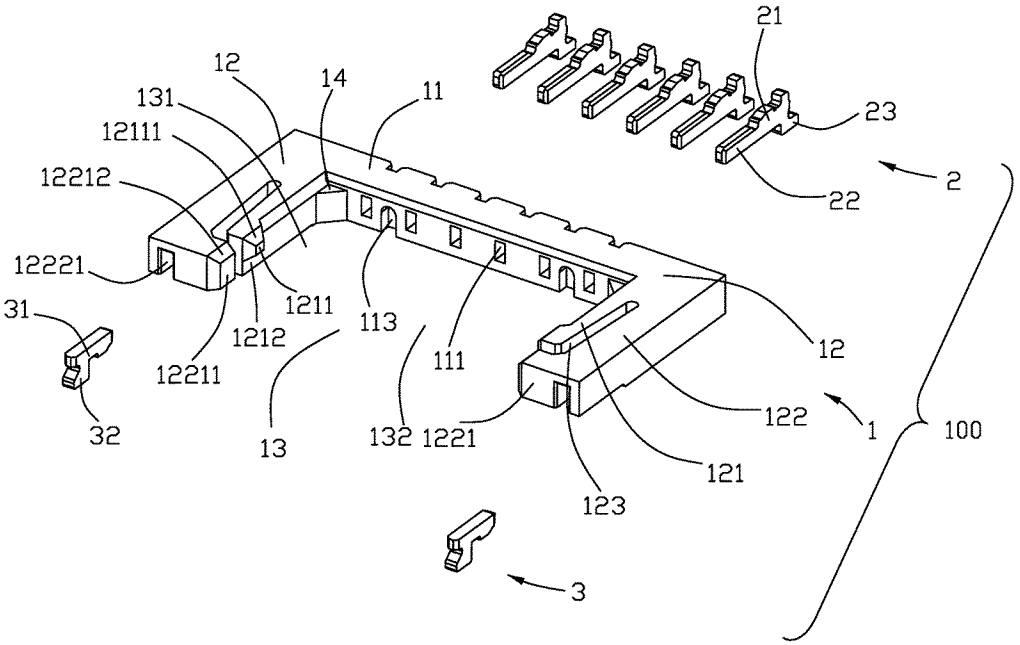
FIG. 3 is an exploded view of a board-end connector of the electrical connector assembly.
Figure 4:
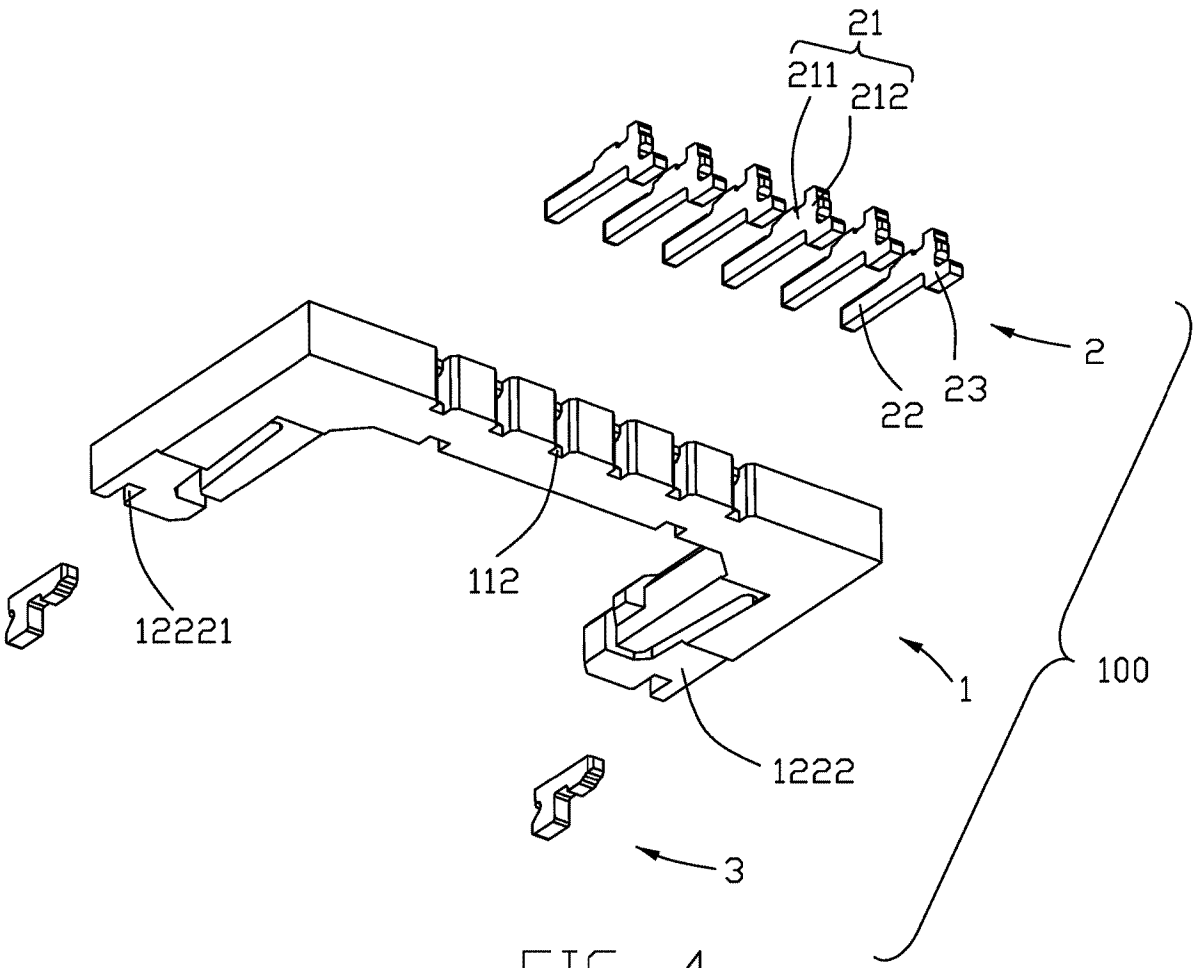
FIG. 4 is another exploded view of the board-end connector in FIG. 3.
Figure 5:
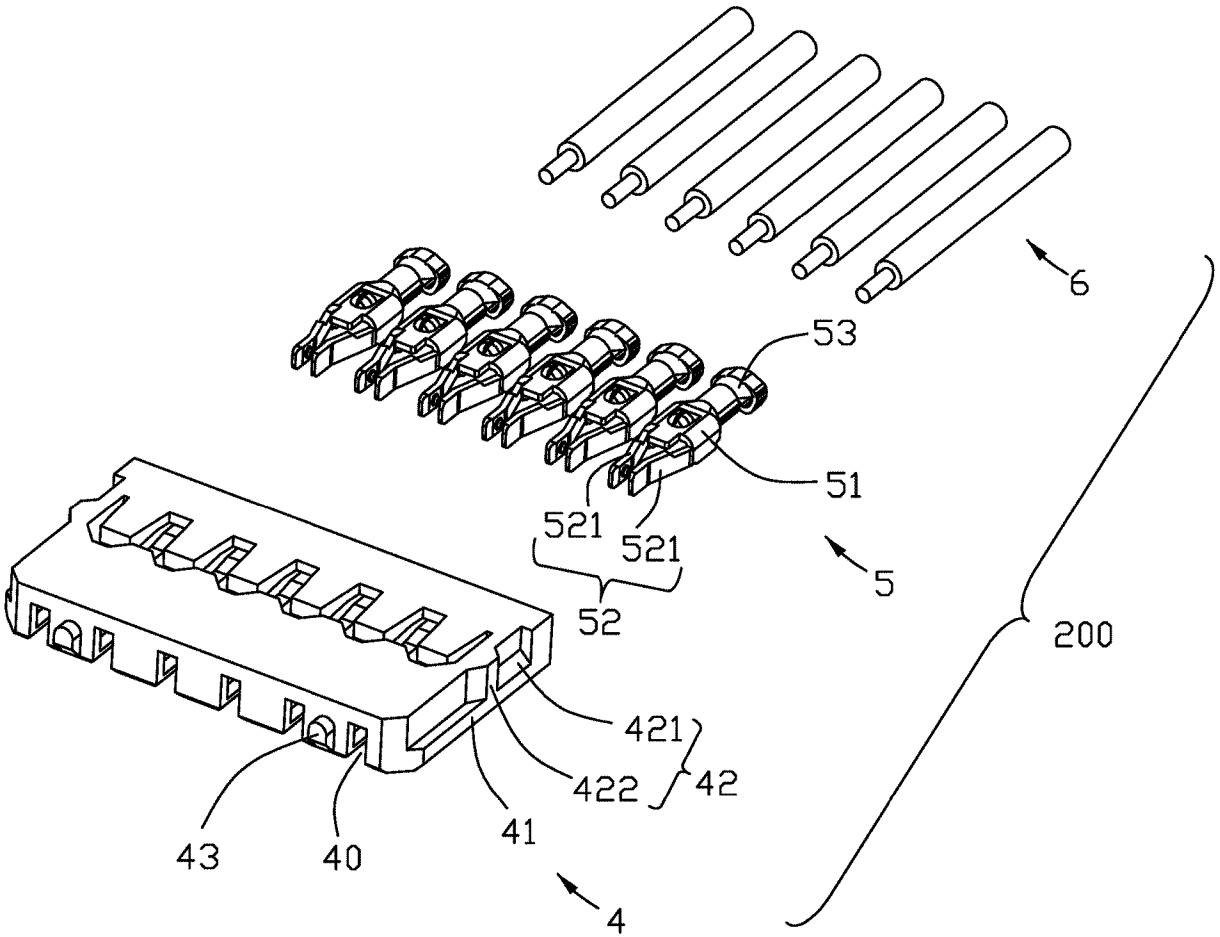
FIG. 5 is an exploded view of a cable-end connector of the electrical connector assembly.
Figure 6:
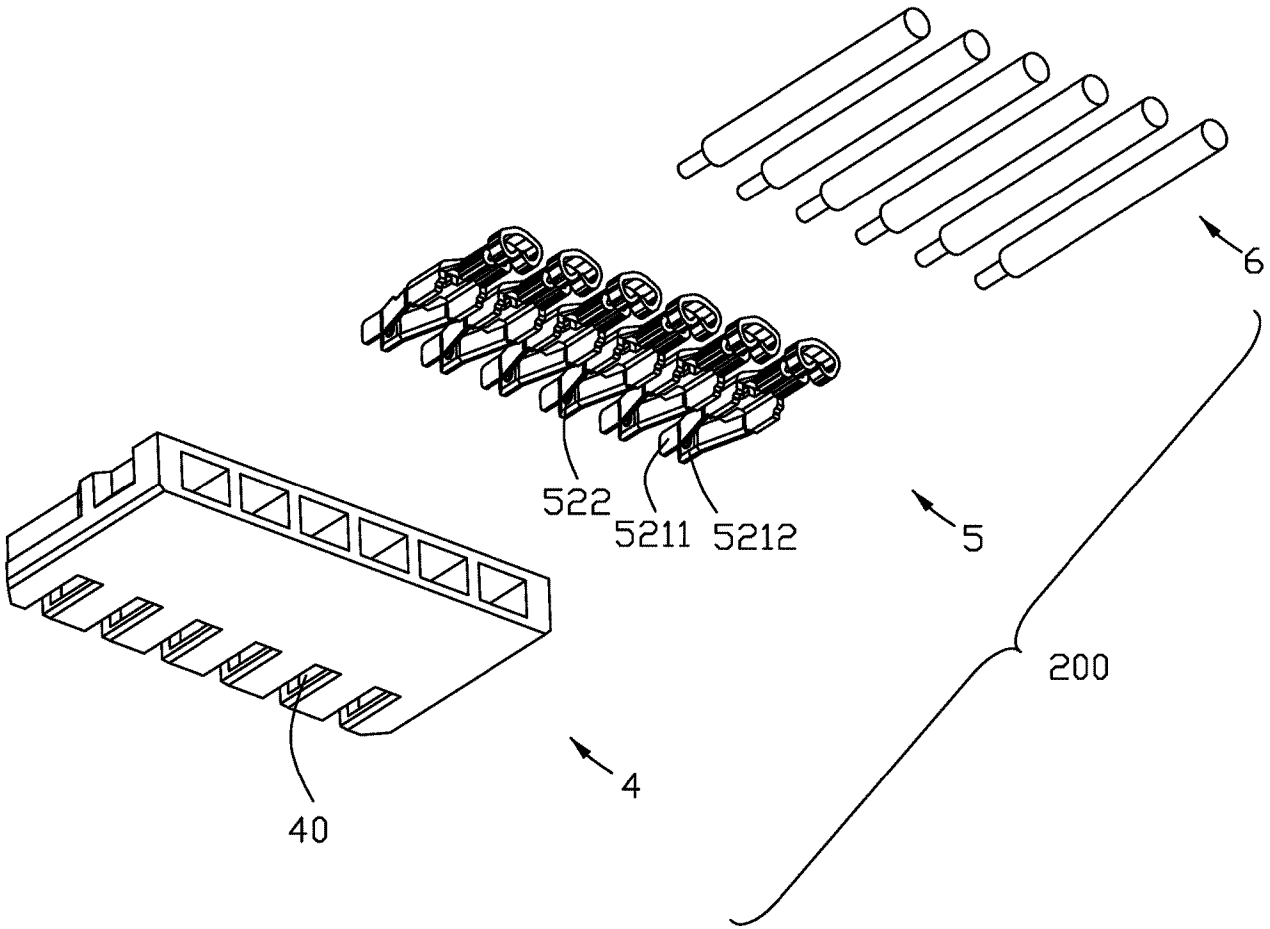
FIG. 6 is another exploded view of the cable-end connector in FIG. 5.

Referring to FIGS. 1 to 7, an electrical connector assembly 1000 includes a board-end connector 100 and a mating cable-end connector 200. The board-end connector 100 includes an elongate insulative housing 1 and a plurality of contacts 2 retained to the insulative housing 1. A pair of soldering pieces 3 may be further provided for securely fixing the insulative housing 1 to a printed circuit board to which the board-end connector 100 is mounted. The cable-end connector 200 includes an insulative housing 4, a plurality of contacts 5 retained to the insulative housing 4, and a cable 6 connected to the contacts 5.

Referring specifically to FIGS. 3 to 6, the insulative housing 1 of the board-end connector 100 has a base 11 and a pair of side walls 12 together defining a receiving space 13 opening forwardly, upwardly, and downwardly. The space 13 includes an upper port 131 for insertion of the cable-end connector 200 in a top-to-bottom direction and a front port 132 for insertion of the cable-end connector 200 in a front-to-back direction. The contact 2 has a retaining portion 21, a contacting portion 22, and a tail 23. The base 11 has a plurality of horizontal grooves 111 and vertical grooves 112. The retaining portion 21 has a first section 211 secured to the groove 111 and a second section 212 secured to the groove 112. The tail 23 is partly received in the groove 112.

The contact 5 of the cable-end connector 200 has a retaining portion 51, a front contacting end 52, and a rear wire-securing end 53. The contacting end 52 includes a pair of spring arms 521. The insulative housing 4 of the cable-end connector 200 has a plurality of grooves 40 each extending through a front and a bottom thereof for accessing the contacting end 52 received therein. The spring arm 521 has a front guiding portion 5211 for insertion of the contact 2 in the horizontal, front-to-back direction and a lower guiding portion 5212 for insertion of the contact 2 in the vertical, top-to-bottom direction. The spring arm 521 further has a feature 5212 for improved contact with the contact 2.

Figure 7:
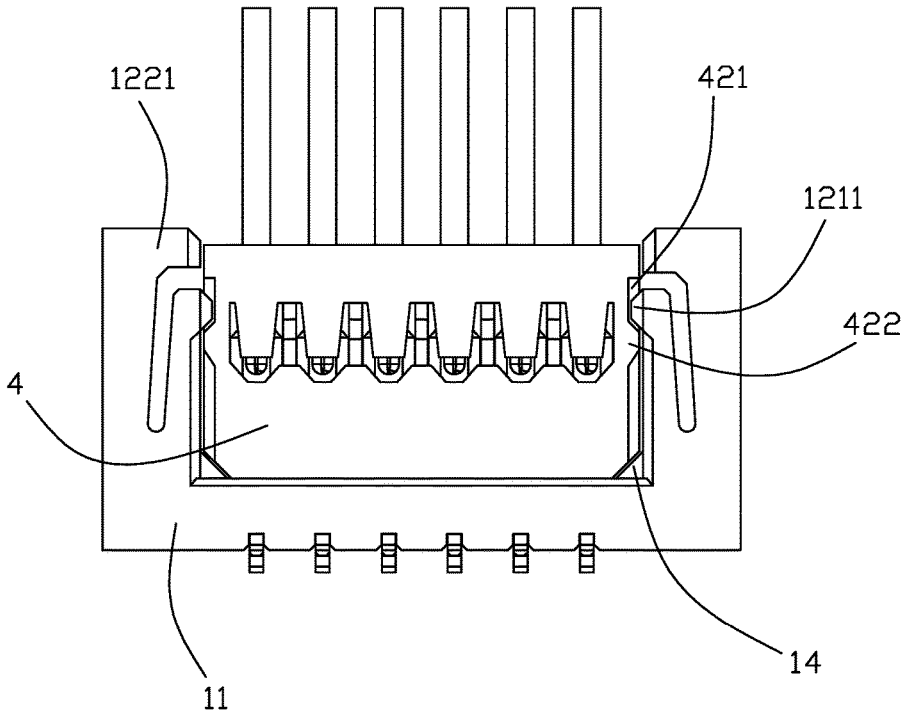
FIG. 7 is a top plan view of the electrical connector assembly.

Referring in conjunction with FIG. 7, each of the side walls 12 has a resilient inner arm 121 and a stationary outer arm 122. The inner arm 121 and the outer arm 122 are spaced by a substantially L-shaped gap 123. Correspondingly, the insulative housing 4 of the cable-end connector 200 has an engaging structure 42 on each of two opposite sides 41 thereof for engaging the resilient inner arm 121. Moreover, the resilient inner arm 121 includes a protrusion 1211 disposed at an upper corner thereof and a planar portion 1212 located under the protrusion 1211. The protrusion 1211 has a respective guiding surface 12111 at each of its front, rear, top, and bottom. The guiding surface 12111 may be planar, curved, or rounded. The engaging structure 42 includes a locking side protrusion 422 and a locking step 421 behind the side protrusion 422. After mating of the cable-end connector 200 to the board-end connector 100, an upper surface of the step 421 and a rear surface of the side protrusion 422 are engaged by the protrusion 1211.

In order to ensure a smooth disengagement of the cable-end connector 200 from the board-end connector 100, the stationary outer arm 122 includes a protrusion 1221 located in front of a foremost end of the resilient inner arm 121. The protrusion 1221 has a planar portion 12211. Furthermore, the protrusion 1221 of the outer arm 122 extends beyond the insulative housing 4 of the cable-end connector 200. Additionally, at the junction of the base 11 and the side wall 12, a triangular corner block 14 may be provided.

A bottom of the stationary outer arm 122 is formed a recess 1222 and a groove 12221 in the recess 1222 for receiving the soldering piece 3. The soldering piece 3 has a retaining portion 31 and a tail 32. A bottom surface of the inner arm 121 is substantially flush with a plane surface of the recess 1222. A front of the insulative housing 4 of the cable-end connector 200 may be disposed one or more ribs 43 and corresponding grooves 113 may be formed on the base 11 of the connector housing 1.

By provision of the resilient inner arm 121 extending along the horizontal, front-to-back direction and having a guiding protrusion 1211, the resilient inner arm 121 is operable in the vertical, top-to-bottom direction. The resilient inner arm is also operable in the horizontal, front-to-back direction to move toward the stationary outer arm 122. Provision of the side protrusion 422 and the step 421 on the cable-end connector housing 4 facilitates such movement of the resilient inner arm 121 in both the vertical, top-to-bottom direction and the horizontal, front-to-back direction. Notably, the grooves 42 extend through the front face and the bottom face of the housing around the front end of the housing 4 so as to allow the corresponding contacts 2 of the board-end connector 100 to be mated with the corresponding contact 5 of the cable end connector 200 in both the front-to-back direction and the vertical direction. Correspondingly, the locking side protrusion 422 and the locking step 421 are used to lock the mated cable end connector 200 and the board end connector 100 in both the front-to-back direction and the vertical direction, respectively.

What is claimed is:

1. An electrical connector comprising:

an insulative housing having a base and a pair of side walls, each side wall having a resilient inner arm and a stationary outer arm; and a plurality of contacts retained to the insulative housing; wherein the resilient inner arm extends along a horizontal, front-to-back direction and has a front end operable in both a vertical, top-to-bottom direction and the horizontal, front-to-back direction to move toward the stationary outer arm; wherein the resilient inner arm and the stationary outer arm are spaced by a gap of substantially L-shaped; wherein the resilient inner arm includes a protrusion having a respective guiding surface at each of a front, rear, top, and bottom thereof; wherein the protrusion of the resilient inner arm is disposed at an upper corner of the resilient inner arm.

2. The electrical connector as claimed in claim 1, wherein the stationary outer arm includes a protrusion located in front of the front end of the resilient inner arm.

3. An electrical connector assembly comprising:

a first connector including an insulative housing and a plurality of first contacts retained to the insulative housing, the insulative housing having a base and a pair of side walls, each side wall having a resilient inner arm and a stationary outer arm, the resilient inner arm having a front end; and a second connector for mating with the first connector, the second connector including an insulative housing and a plurality of second contacts retained to the insulative housing, the insulative housing having a pair of side protrusions and a pair of steps behind the side protrusions; wherein the front ends of the resilient inner arms are movable outwardly by a front-to-back movement of the side protrusions or by a top-to-bottom movement of the steps; wherein the resilient inner arm and the stationary outer arm are spaced by a gap of substantially L-shaped; wherein the resilient inner arm includes a protrusion having a respective guiding surface at each of a front, rear, top, and bottom thereof; wherein the stationary outer arm includes a protrusion located in front of the front end of the resilient inner arm; wherein the protrusion of the stationary outer arm extends beyond the insulative housing of the second connector.

4. The electrical connector assembly as claimed in claim 3, wherein the front end of the resilient inner arm engages a top of the step.

5. The electrical connector assembly as claimed in claim 3, wherein the protrusion of the resilient inner arm is disposed at an upper corner of the resilient inner arm.

6. An electrical connector assembly a first connector including an insulative housing and a plurality of first contacts retained to the insulative housing, the insulative housing having a base and a pair of side walls, each side wall having a resilient inner arm deflectable in a transverse direction, the resilient inner arm having a front locking end in a front-to-back direction perpendicular to said transverse direction; and a second connector for mating with the first connector, the second connector including an insulative housing and a plurality of second contacts retained to the insulative housing, the insulative housing having a pair of laterally extending locking side protrusions and a pair of locking steps behind the side protrusions in the front-to-back direction; wherein the housing of the second connector forms a plurality of grooves extending through the housing in both a front face and a bottom face thereof around a front end region so as to allow the second connector to be mated with the first connector along either the front-to-back direction or a vertical direction perpendicular to both said transverse direction and the front-to-back direction, and eventually locked in position by said locking side protrusions in the front-to-back direction, and by the locking step in the vertical direction.

7. The electrical connector assembly as claimed in claim 6, wherein the plurality of first contacts extending into the corresponding grooves in the housing of the second connector to mate with the plurality of second contacts during mating.

8. The electrical connector assembly as claimed in claim 7, wherein the first contact is of a pin type while the second contact is of a dual-beam type sandwiching the corresponding pin type first contact.

9. The electrical connector assembly as claimed in claim 6, wherein each side wall further includes a stationary outer arm outwardly beside and spaced from the corresponding resilient inner arm.

10. The electrical connector assembly as claimed in claim 9, wherein the stationary outer arms are equipped with soldering pieces around front ends, respectively.

11. The electrical connector assembly as claimed in claim 9, wherein front end sections of said pair of stationary outer arms are dimensioned to closely confront the housing of the second connector in the transverse direction while allowing removal of the housing of the second connector from the housing of the first connector along the front-to-back direction.

* * * * *